US007132959B2

(12) United States Patent
Seabury et al.

(10) Patent No.: US 7,132,959 B2
(45) Date of Patent: Nov. 7, 2006

(54) NON-INTERFERING VEHICLE DETECTION

(75) Inventors: Thomas Seabury, Diablo, CA (US); Robert S. Allen, Livermore, CA (US)

(73) Assignee: Diablo Controls, Inc., Diablo, CA (US)

( * ) Notice: Subject to any disclaimer, the term of this patent is extended or adjusted under 35 U.S.C. 154(b) by 76 days.

(21) Appl. No.: 10/787,575

(22) Filed: Feb. 26, 2004

(65) Prior Publication Data

US 2004/0174274 A1 Sep. 9, 2004

Related U.S. Application Data

(60) Provisional application No. 60/452,473, filed on Mar. 5, 2003.

(51) Int. Cl.
*G08G 1/01* (2006.01)

(52) U.S. Cl. ..... 340/933; 340/435; 340/939; 701/301

(58) Field of Classification Search ..... 340/933
See application file for complete search history.

(56) References Cited

U.S. PATENT DOCUMENTS

| | | | | |
|---|---|---|---|---|
| 3,943,339 | A | 3/1976 | Koerner et al. | |
| 4,668,951 | A | 5/1987 | Duley et al. | |
| 4,680,717 | A | 7/1987 | Martin | |
| 4,873,494 | A | 10/1989 | Jefferis | |
| 5,247,297 | A | 9/1993 | Seabury et al. | |
| 5,936,551 | A * | 8/1999 | Allen et al. | 340/941 |
| 6,337,602 | B1 * | 1/2002 | Hilliard et al. | 331/65 |
| 6,556,916 | B1 * | 4/2003 | Waite et al. | 701/117 |
| 6,662,099 | B1 * | 12/2003 | Knaian et al. | 701/117 |
| 6,803,859 | B1 * | 10/2004 | Hilliard et al. | 340/941 |
| 2001/0043124 | A1 * | 11/2001 | Hilliard et al. | 331/65 |
| 2003/0020635 | A1 * | 1/2003 | Hilliard et al. | 340/941 |
| 2004/0179466 | A1 * | 9/2004 | Parsadayan et al. | 370/201 |

* cited by examiner

*Primary Examiner*—Daniel Wu
*Assistant Examiner*—George A. Bugg

(57) ABSTRACT

A technique for operating a vehicle detection system involves obtaining samples randomly from a detector of the vehicle detection system and determining the presence of a vehicle in response to the random samples. When multiple detectors are located in close proximity to each other, the likelihood of interference caused by concurrent sampling events is reduced because of the randomness of the sampling, which in turn reduces the occurrence of incorrect vehicle detection results. Control systems for vehicle detection systems obtain the random samples independently from each other. Because the random samples are obtained independently from each other, multiple inductive loop vehicle detection systems can be operated in close proximity to each other without having to be coordinated or synchronized in any way. The possibility of an incorrect vehicle detection as a result of concurrent sampling events can be further reduced using validity checking techniques.

50 Claims, 8 Drawing Sheets

NON-INTERFERING VEHICLE DETECTION

CROSS-REFERENCE TO RELATED APPLICATION

This application is entitled to the benefit of provisional U.S. patent application Ser. No. 60/452,473, filed 5 Mar. 2003.

FIELD OF THE INVENTION

The invention relates to the field of vehicle detection systems, and more particularly to techniques for dealing with interference between vehicle detectors that are in close proximity to each other.

BACKGROUND OF THE INVENTION

The need to detect motor vehicles for traffic signal control, parking, and access control applications has existed for a substantial period of time. Inductive loop vehicle detection systems are used to provide specific vehicle location in the roadway for signal timing, vehicle speed determination, and vehicle classification. In addition, inductive loop vehicle detectors are used extensively in entry control applications such as electric gates or doors in buildings, garages, residential applications, parking lots, and other controlled access areas.

Typically, inductive loop vehicle detectors have in common an oscillator device, which is contained in the vehicle detector system and is connected to the remote roadway loop system utilizing an isolation transformer and a transmission cable assembly. The oscillator contained in the vehicle detector system will operate at a resonant frequency determined by the value of the fixed capacitors located in the oscillator circuit and the equivalent inductance of the remote roadway loop. In the applications above, the inductance of the loop system decreases and the resonant frequency of the loop system increases from a reference value when a vehicle enters the loop perimeter, or is in close proximity to the roadway loop. The frequency shift of the oscillator system due to a normal sized passenger vehicle entering the loop area is generally only 1% or 2% of the inductance value of the system without a vehicle being present. A small motor vehicle, such as a small motorcycle, may only change the frequency 0.05%.

The presence or absence of a motor vehicle is determined by the vehicle detector system measuring the inductance of the roadway loop and comparing this value with a known inductance value which represents the inductance of the loop with no vehicle present. If the inductance value is presumed to be of sufficiently lower than the reference value, the vehicle detection system outputs a logic signal to external devices such as traffic controllers or gate operator systems. As long as the inductance value remains sufficiently low, the vehicle detection system will continue to output the same signal (referred to commonly as the "detect" signal).

Inductive loop vehicle detection systems are both emitters and receptors of electromagnetic fields. These electric fields are known to be of very low power. However, if the roadway loops are in close proximity to each other, the electromagnetic field from one roadway system inductively couples into other loop systems. The result of this loop field coupling by multiple vehicle detectors systems is an interference to other individual detector oscillator systems. The effect of two or more vehicle detector loops coupling inductively with each other is commonly referred to as crosstalk. The result of this electromagnetic field coupling is that each system tries to change the frequency of the other system. This will result in one or both systems operating at either a higher or lower frequency than it would without the influence of the other system.

Mutual interference between vehicle detectors has existed for a substantial period of time and can be severe, particularly if a loop system is operating with a resonant frequency close to another system's resonant frequency. The interfering signal will be a modulation product consisting of all frequencies of the various detectors plus the sum and difference of all of the detector loop frequencies. The operation of vehicle detection systems, each with a slightly different frequency, is not unlike that of a plurality of radio transmitters operating on the same frequency. This situation is commonly referred to as "transmitter jamming."

Crosstalk in vehicle detection systems can cause random false vehicle detect signals from one or more detector systems. It is also common, if the detector system is experiencing crosstalk, to observe a vehicle detector that will not output a detect signal when a vehicle is present over the roadway loop. This is also an undesirable situation that can result in disruptive equipment operation and will cause traffic lights and/or gate systems to malfunction.

The interference between various detector systems within a given area has been dealt in various ways. For example, the individual systems have included manual systems for varying the operating frequencies of the loop systems. This has been accomplished in the past, and is still being accomplished, by manually adding (or subtracting) capacitors or inductors of different values that cause the natural resonance frequency of the roadway loop to shift to a value different than any other systems in the vicinity. The selection of the various frequencies must be coordinated among all of the detector systems that are suspected to have roadway loops that are in close enough proximity to each other to suffer from interference. The manual selection of different frequencies is generally accomplished at the time of installation of the devices and it does not take into account the change of the values of all the components in the resonant circuit with both time, temperature, and other variables. Many times a frequency selection is made only to have the problem of crosstalk reappear at a future time as changes in the value of the oscillator components and the roadway loops occur.

Another technique for dealing with interference has been the use of sequential scanning of more that one detector system. The detector systems are controlled by a master sequencing device, which only operates one oscillator at a time in a controlled sequence. Systems have been in existence for a number of years that use this sequential scanning principal. A drawback to sequential scanning is that fact that the operation of multiple detection systems must be synchronized with each other. Another drawback is that only the loops that are controlled by this single device are corrected and typically these types of systems can only manage up to four detection loops simultaneously. These multiple detection devices have no communication with other nearby similar devices and therefore only the scanned channels of detection common to this single device are exempt from interference from each other. In a typical traffic intersection application, the total number of roadway loop systems may be a large number and the synchronization of only groups of four, is of limited value in solving the overall crosstalk problem.

While some techniques for dealing with interference between vehicle detectors exist, there is still a need for techniques that are easy to implement and that are applicable to multiple detection systems.

SUMMARY OF THE INVENTION

A technique for operating a vehicle detection system involves obtaining samples randomly from a detector of the vehicle detection system and determining the presence of a vehicle in response to the random samples. When multiple detectors are located in close proximity to each other, the likelihood of interference caused by concurrent sampling events is reduced because of the randomness of the sampling, which in turn reduces the occurrence of incorrect vehicle detection results. Control systems for vehicle detection systems obtain the random samples independently from each other. That is, the timing of the sampling events initiated by each control system is not related to the other control system. Because the random samples are obtained independently from each other, multiple inductive loop vehicle detection systems can be operated in close proximity to each other without having to be coordinated or synchronized in any way.

Samples are obtained randomly by obtaining inductance measurements during short periods of time at random time intervals. The random intervals between sampling events can be controlled by any technique as long as randomness is achieved. Typically, a maximum time limit between random samples is set in order to ensure that vehicles are detected within an acceptable time period.

In an embodiment, samples are obtained randomly by establishing sampling frames of a known duration and dividing the sampling frames into multiple time slots. One time slot within each frame is then randomly selected as the time slot in which a sampling event is to occur. The time slots can be selected using a random number generator. The respective inductive loop detector is then energized during the selected time slot and the inductance of the inductive loop detector is measured to obtain a sample. Once the sample is obtained, the inductive loop detector is de-energized until it is time to obtain the next sample.

When two or more inductive loop vehicle detection systems are operating independently using random sampling with limited sample durations, concurrent sampling events rarely occur. The likelihood of concurrent sampling events is a function of the sampling frequency and the sampling duration (also referred to as "duty cycle") and can be calculated using statistical analysis. The possibility of an incorrect vehicle detection as a result of concurrent sampling events can be further reduced using validity checking techniques.

Other aspects and advantages of the present invention will become apparent from the following detailed description, taken in conjunction with the accompanying drawings, illustrating by way of example the principles of the invention.

BRIEF DESCRIPTION OF THE DRAWINGS

Throughout the description, similar reference numbers may be used to identify similar elements.

DETAILED DESCRIPTION

Figure 1:
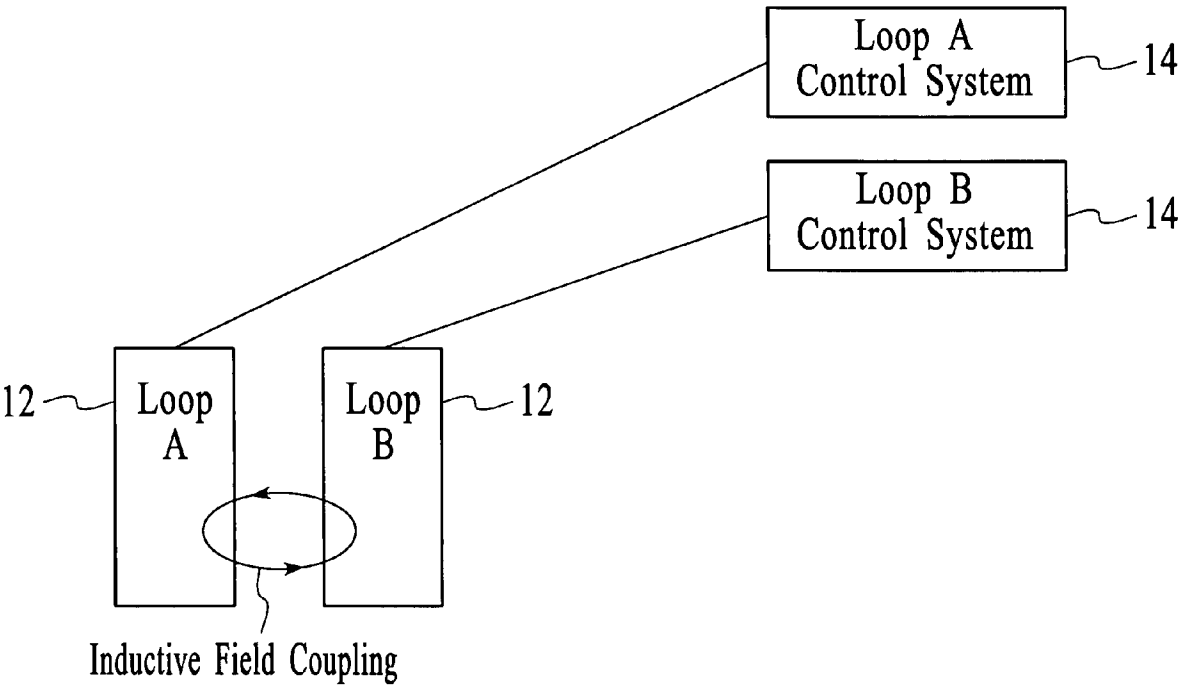
FIG. 1 depicts two inductive loop vehicle detection systems that utilize random sampling to deal with the problem of interference between the two systems.

FIG. 1 depicts two inductive loop vehicle detection systems (ILVDS) that utilize random sampling to deal with the problem of interference between the two systems. Each of the inductive loop vehicle detection systems includes an inductive loop detector 12 and a control system 14. The inductive loop detectors are typically formed by multiple turns of electrically conductive wire buried beneath a roadway surface at a location where vehicle detection is desired. The inductive loop detectors may include additional supporting elements such as transformers, capacitors, oscillators, and signal processing circuits (none of which are shown in FIG. 1). When an inductive loop detector is energized using, for example, an oscillator, an inductive field is created at the loop. The inductance of the loop detector changes when a vehicle is near the inductive loop detector and the presence of a vehicle can be determined by measuring the inductance of the loop detector. Measuring the inductance or change in inductance of a loop is typically achieved by measuring the frequency or period of an oscillating signal that is applied to the loop. Throughout this description, the measuring of inductance may include the measurement of the frequency or period of an oscillating signal. Techniques, such as the period measurement technique, for measuring the inductance of loop detectors are well known in the field.

The control systems 14 of the two inductive loop vehicle detection systems control the sampling of the corresponding inductive loop detectors. For example, the control systems control the energizing of the inductive loops, the measurement of loop inductance, and the determination of the presence of vehicles. For description purposes, it is assumed that the inductive loop detectors depicted in FIG. 1 are located close enough to each other that inductive field coupling can cause incorrect vehicle detection results (e.g., incorrectly indicating the presence or absence of a vehicle). In accordance with the invention, the control systems of the two inductive loop vehicle detection systems are configured to obtain samples randomly from the respective inductive loop detectors and to determine the presence of a vehicle near the corresponding inductive loop detector in response to the random samples. That is, the control systems are configured to obtain samples that are separated by random time intervals. Because the samples are obtained randomly, the occurrence of interfering sampling events is reduced, which in turn reduces the occurrence of incorrect vehicle detection results. The control systems obtain the random samples independently from each other. That is, the timing of the sampling events initiated by each control system is not related to the other control system. Because the random samples are obtained independently from each other, multiple inductive loop vehicle detection systems can be operated in close proximity to each other without having to be coordinated or synchronized in any way. Example embodiments of a control system are described below.

Samples are obtained randomly by obtaining inductance measurements during short periods of time at random time intervals. The random intervals between sampling events can be controlled by any technique as long as randomness is achieved. Typically, a maximum time limit between random samples is set in order to ensure that vehicles are detected within an acceptable time period. For example, an acceptable time period for vehicle detections may be from 100 to 500 milliseconds. Assuming a response time of 400 milliseconds and a requirement to have four samples upon which to make a vehicle decision, the maximum time interval between sampling events would be 100 milliseconds. In this example, acceptable vehicle detection can be achieved as long as one sampling event occurs randomly during each 100 millisecond time interval.

In an embodiment, random sampling involves establishing sampling frames of a known duration (e.g., 1 second per frame). The sampling frames are then divided into multiple time slots. For example, sampling frames of 1 second are divided into 16 time slots although other frame times and numbers of time slots can be used. One time slot within each frame is then randomly selected as the time slot in which a sampling event is to occur. The time slots can be selected using a random number generator. The respective inductive loop detector is then energized during the selected time slot and the inductance of the inductive loop detector is measured to obtain a sample. Once the sample is obtained, the inductive loop detector is de-energized until it is time to obtain the next sample. When two or more inductive loop vehicle detection systems are operating independently using random sampling with limited sample durations, concurrent sampling events rarely occur. The likelihood of concurrent sampling events is a function of the sampling frequency and the sampling duration (also referred to as "duty cycle") and can be calculated using statistical analysis. As is described in detail below, the possibility of an incorrect vehicle detection as a result of concurrent sampling events can be further reduced using validity checking techniques.

Figure 2:
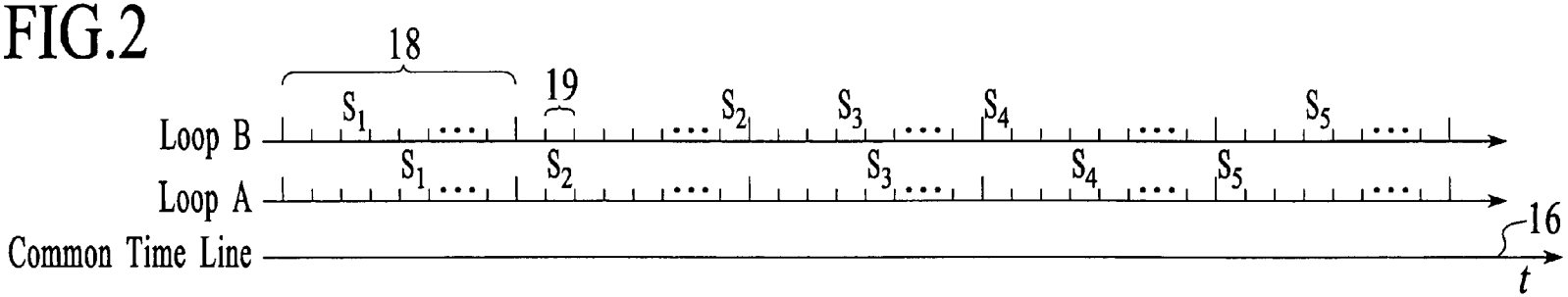
FIG. 2 depicts exemplary time lines of sampling events that occur for the two inductive loop vehicle detection systems depicted in FIG. 1.

FIG. 2 depicts exemplary time lines of sampling events that occur for the two inductive loop vehicle detection systems (A and B) depicted in FIG. 1 using random sampling as described herein. The sampling event time lines identify the sampling frames 18, time slots 19 within each sampling frame, and the particular time slots in which sampling events (e.g., $S_1$, $S_2$, $S_3$, $S_4$, and $S_5$) occur, all relative to a common time line 16. As depicted in the sampling time lines for inductive loop vehicle detection systems A and B, the sampling events for each inductive loop vehicle detection system occur in random time slots and do not occur concurrently with each other. It should also be noted that because the two inductive loop vehicle detection systems are operated independent of each other, it is not necessary for the sampling frames to be synchronized. That is, the sampling frames can begin and end at different times relative to the common time line. Further, it is not even necessary for the sampling frames and time slots to be of the same duration or count, although they are depicted as the same in FIG. 2.

Figure 3:
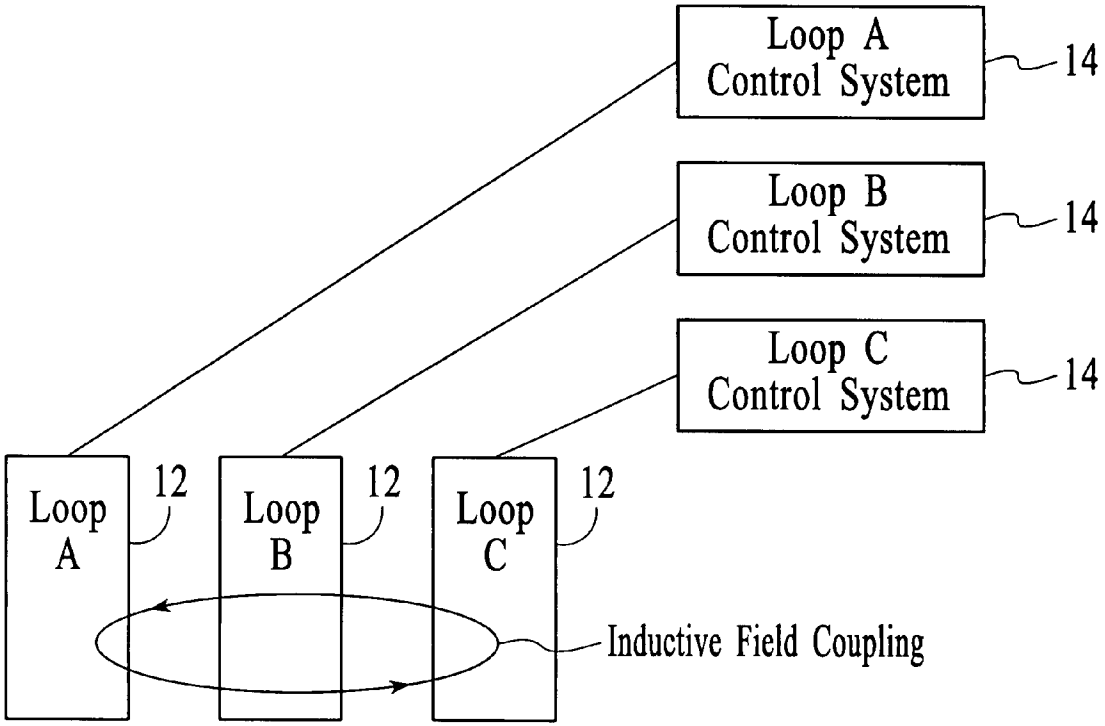
FIG. 3 depicts a third inductive loop vehicle detection system that has been added to the two systems depicted in FIG. 1.
Figure 4:
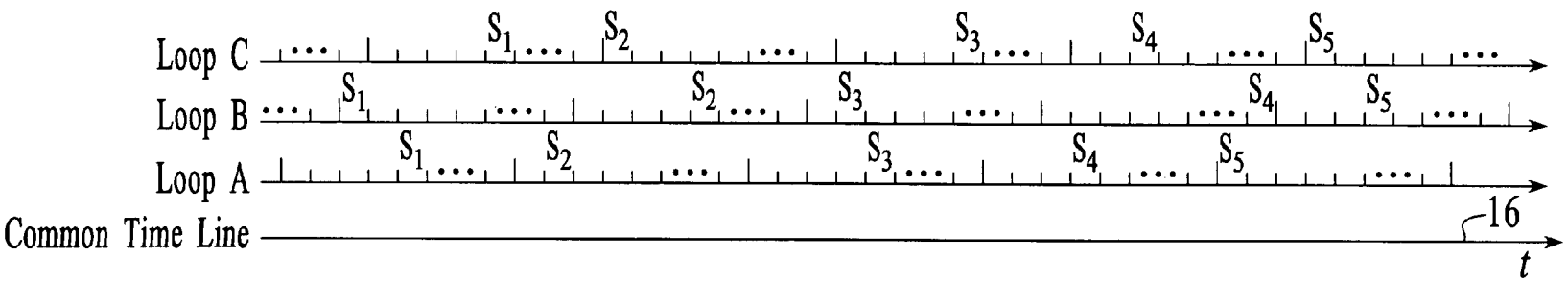
FIG. 4 depicts exemplary sampling event time lines relative to a common time line for the three inductive loop vehicle detection systems depicted in FIG. 3.

Because the inductive loop vehicle detection systems operate independently from each other, additional inductive loop detectors that utilize random sampling can be placed in close proximity to the existing inductive loop detectors without having to coordinate or synchronize with the existing inductive loop vehicle detection systems. FIG. 3 depicts a third inductive loop vehicle detection system (system C) that has been added to the two systems (A and B) depicted in FIG. 1. The three inductive loop vehicle detection systems have their inductive loop detectors 12 located in close proximity to each other. The inductive loop detectors are located close enough to each other that inductive field coupling between any of the loops can cause incorrect vehicle detection results (e.g., incorrectly indicating the presence or absence of a vehicle). FIG. 4 depicts exemplary sampling event time lines relative to a common time line 16 for the three inductive loop vehicle detection systems depicted in FIG. 3. Similar to the sampling event time lines depicted in FIG. 2, the sampling events for each inductive loop vehicle detection system occur in random time slots and do not occur concurrently. Additionally, because the three inductive loop vehicle detection systems are operated independently of each other, the sampling frames do not need to be synchronized. Likewise, the sampling frames and time slots do not need to be of the same duration of count.

Figure 5:
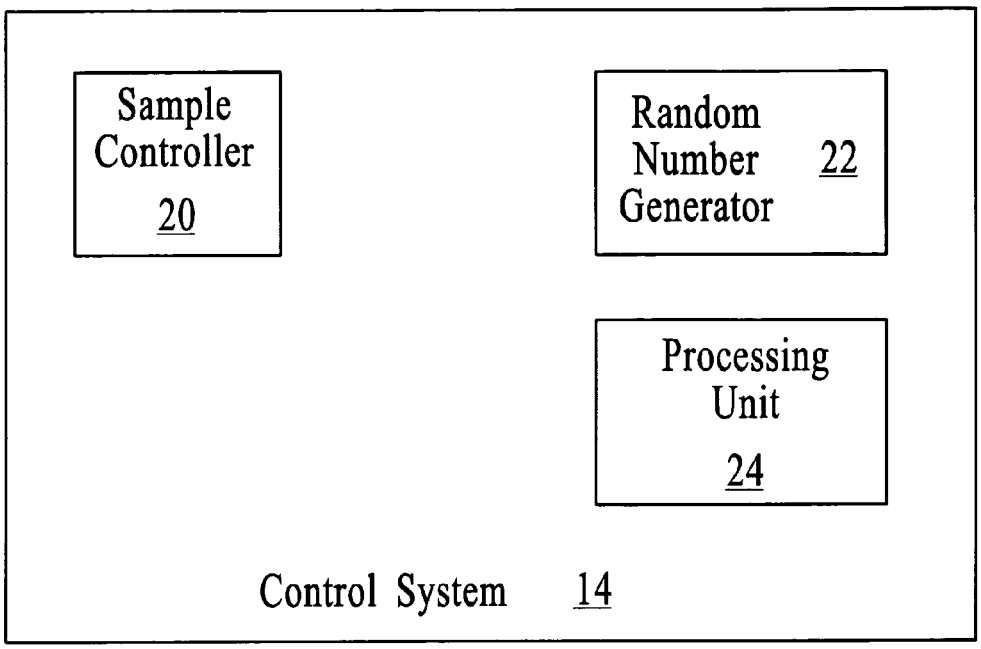
FIG. 5 depicts an exemplary embodiment of one of the control systems depicted in FIGS. 1 and 3.

The control system of an inductive loop vehicle detection system can be implemented in different ways. FIG. 5 depicts an exemplary embodiment of one of the control systems depicted in FIGS. 1 and 3. The control system 14 includes a sample controller 20, a random number generator 22, and a processing unit 24. The sample controller controls the obtaining of samples from a corresponding inductive loop detector. In particular, the sample controller controls the energizing and de-energizing of the inductive loop detector and the measurement of the loop inductance.

The random number generator 22 generates random numbers that are used in the obtaining of random samples. In an embodiment, random numbers generated by the random number generator are provided to the sample controller 20 and are used to select time slots within the sampling frames. The random number generator may utilize any technique for generating random numbers. Numbers generated by random number algorithms are often referred to as "pseudorandom" numbers and therefore throughout the description, the terms random or random number are intended to include pseudorandom or pseudorandom number.

The processing unit 24 processes the random samples that are obtained by the sample controller 20 to determine the presence or absence of a vehicle near a corresponding inductive loop detector. For example, the processing unit takes the inductance measurements from the sample controller and uses the measurements to determine the presence or absence of a vehicle. The processing unit may also manage the timing control aspects of the random sampling, such as the establishment and management of the sampling frames and time slots. The processing unit may also perform validity checking to reduce the possibility of incorrect vehicle detection determinations. The processing unit may be embodied as a multifunction processor, memory, software, or any combination thereof.

In FIG. 5, the sample controller 20, random number generator 22, and processing unit 24 are depicted as separate functional blocks, although it should be understood that the respective functions can be distributed within a control system in any manner. Additionally, the sampling controller, the random number generator, and the processing unit may be embodied as hardware, software, firmware, or any combination thereof.

Figure 6:
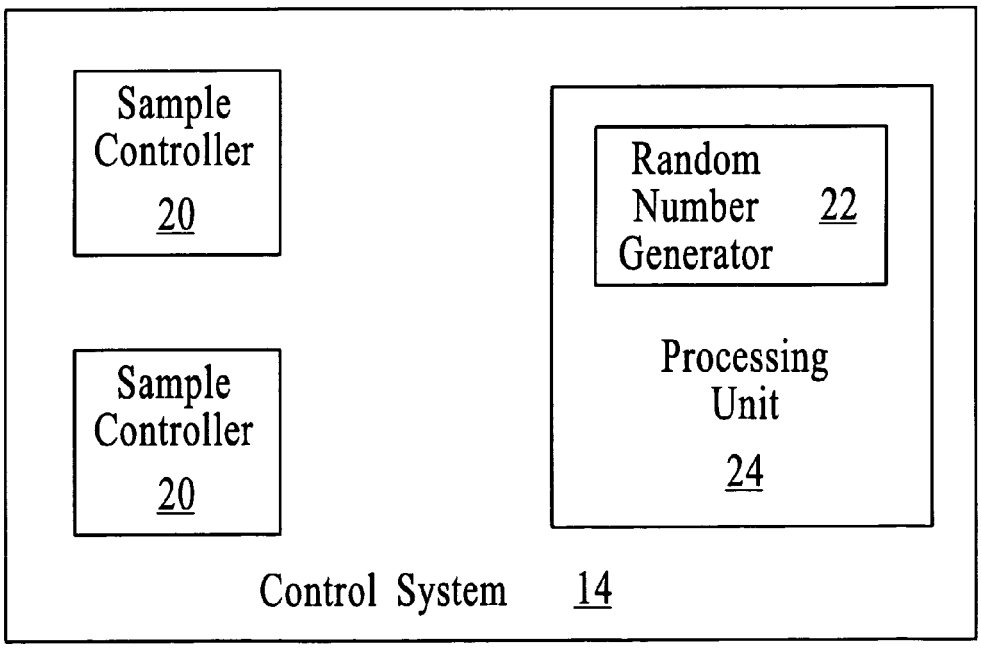
FIG. 6 depicts an embodiment of a control system that is configured to control two inductive loop detectors.

More than one inductive loop detector can be controlled by the same control system while still providing independent random sampling. FIG. 6 depicts an embodiment of a control system 14 that is configured to control two inductive loop detectors. As depicted, the control system includes loop-specific sample controllers 20, a shared processing unit 24, and a shared random number generator 22. The resources of the processing unit and the random number generator are shared among the two sample controllers. Even though some resources are shared, the randomness of the sampling can be maintained independent for each loop detector. As stated above, it is possible for any of the functions (e.g., the functions of the sample controller, the random number generator, and the processing unit) to be distributed throughout the control system. For example, the random number generator can be incorporated into the processing unit (as shown in FIG. 6) or any other part of the control system.

Figure 7:
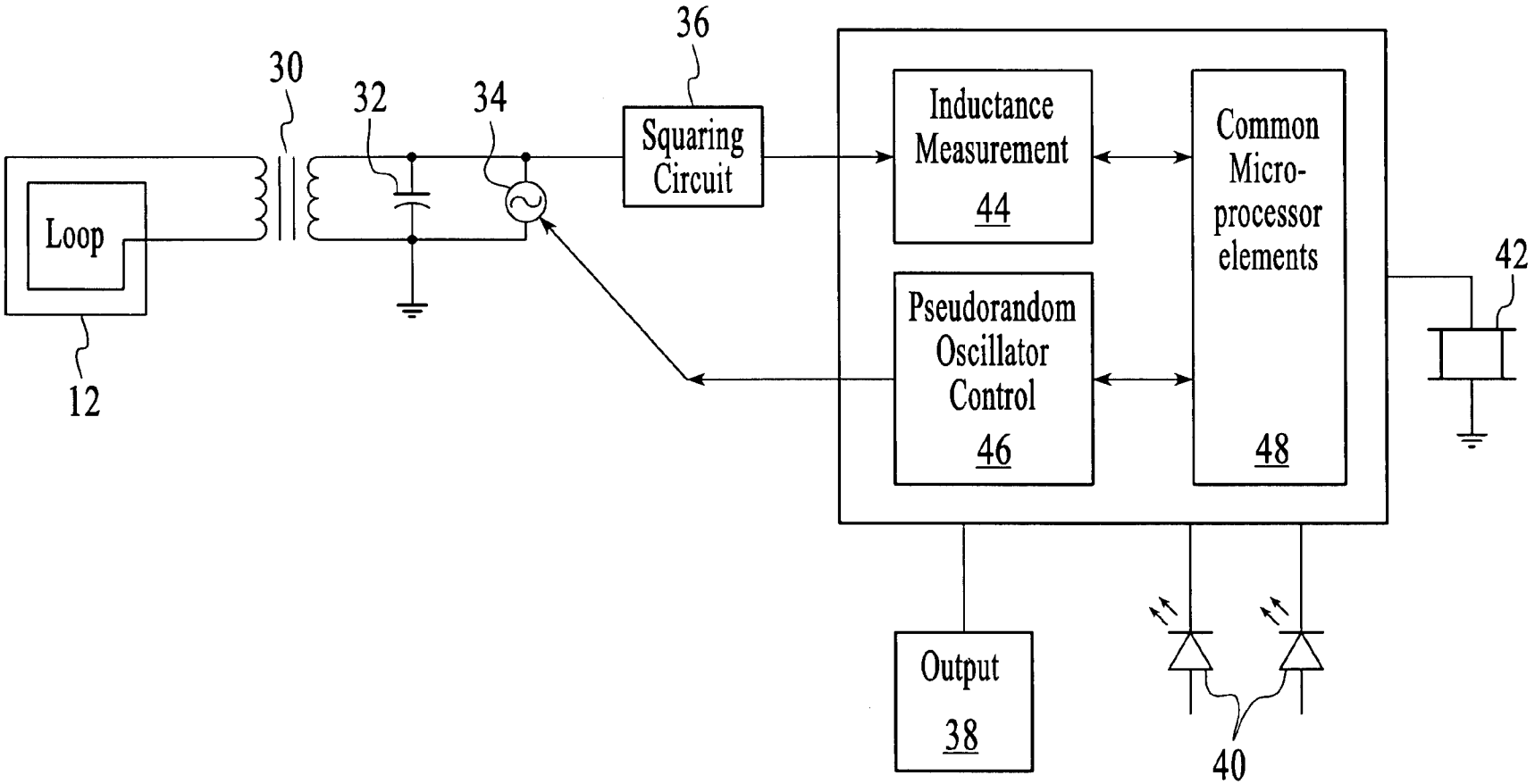
FIG. 7 depicts an embodiment of an inductive loop vehicle detection system that utilizes random sampling.

Attention is now called to FIG. 7, which depicts an embodiment of an inductive loop vehicle detection system that utilizes random sampling. The inductive loop vehicle detection system includes a loop 12, a transformer 30, a capacitor 32, an oscillator 34, a squaring unit 36, an output 38, indicators 40, a clock source 42, and a control system 14. The control system includes an inductance measurement block 44, a pseudorandom oscillator control block 46, and a microprocessor block 48. In a typical application, the loop is formed by multiple turns of electrically conductive wire buried immediately beneath a roadway surface and parallel to the surface. The loop can be constructed by placing a small number of wire turns (e.g. 3 or 4) into a slot cut into the roadway. The loop typically will be a rectangular pattern measuring 4 feet by 4 feet or a circular loop measuring 6 feet in diameter. It is well known in the art of vehicle detection, that loops of various sizes and configurations may be used. In roadway traffic applications, substantially larger dimensioned loops may be used to extend the detection zone. Typically, loops measuring 6 feet by 50 feet are found installed in left turn lanes at traffic controlled intersections. Other configurations of roadway loops may include multiple loops connected electrically in parallel or series and connected to a common oscillator to provide very large zones of detection. In parking and access control applications, the loop may be 2 feet by 4 feet to create a smaller roadway detection area.

Any electrically conductive material, such as a vehicle entering over the area of the loop 12 will change the inductance of the loop and it is a well known principal that by measuring the change of inductance of these loops and comparing these inductance values with previous values (i.e., reference values), the presence or absence of an item such as a vehicle may be determined.

To create a system to measure the inductance of the loop 12, the loop is connected to the loop oscillator 34 that is typically housed in an equipment cabinet at the side of a roadway. The function of the transformer 30 is well known in the vehicle detection industry. In particular, the transformer is used to couple the roadway loop to the oscillator and may provide for vehicle detection if one side of the loop system should become inadvertently shorted to ground.

As is also well known in the art, the circuitry of the oscillator 34, the capacitor 32, and the loop 12 form a resonant circuit that will oscillate at a frequency determined by the fixed capacitance of the capacitor and the variable inductance of the loop. The inductance of the loop decreases and the resonant frequency of the loop increases from a reference value when a vehicle enters the vicinity of the loop. The increase in the resonant frequency of the system from the reference value due to a vehicle entering the vicinity of the loop will vary depending on the characteristics of the vehicle.

In an embodiment, logic contained in the pseudorandom oscillator control block 46 is used to energize the oscillator 34 in a pseudorandom manner, the inductance measurement block 44 measures the inductance of the loop 12, and the microprocessor block 48 supports the processing of the random samples and determines the presence or absence of vehicles in response to the random samples. The squaring circuit 36, is incorporated into the system to convert a sine wave signal from the oscillator system 34 to a square wave so that the square wave may be presented to the control system 14 for processing. The output 38 may be a switch or relay output device that interfaces with external equipment. The external equipment may be an electromechanical relay or a solid state switch device or other logic signal to communicate the presence or absence of a vehicle from the vehicle detector to external devices (e.g. electrical operated gates or traffic controllers). The indicators 40 are devices that give an indication that the detector is operating correctly. The indicators may be a simple "detect" indication. The clock source 42 (e.g., a crystal oscillator) is used to provide the microcontroller 48 with an extremely stable time base and to serve as a stable reference time source for all of the microcontroller functions. In an embodiment, the clock source may be internal to the control system (e.g., incorporated within the microprocessor).

Figure 8:
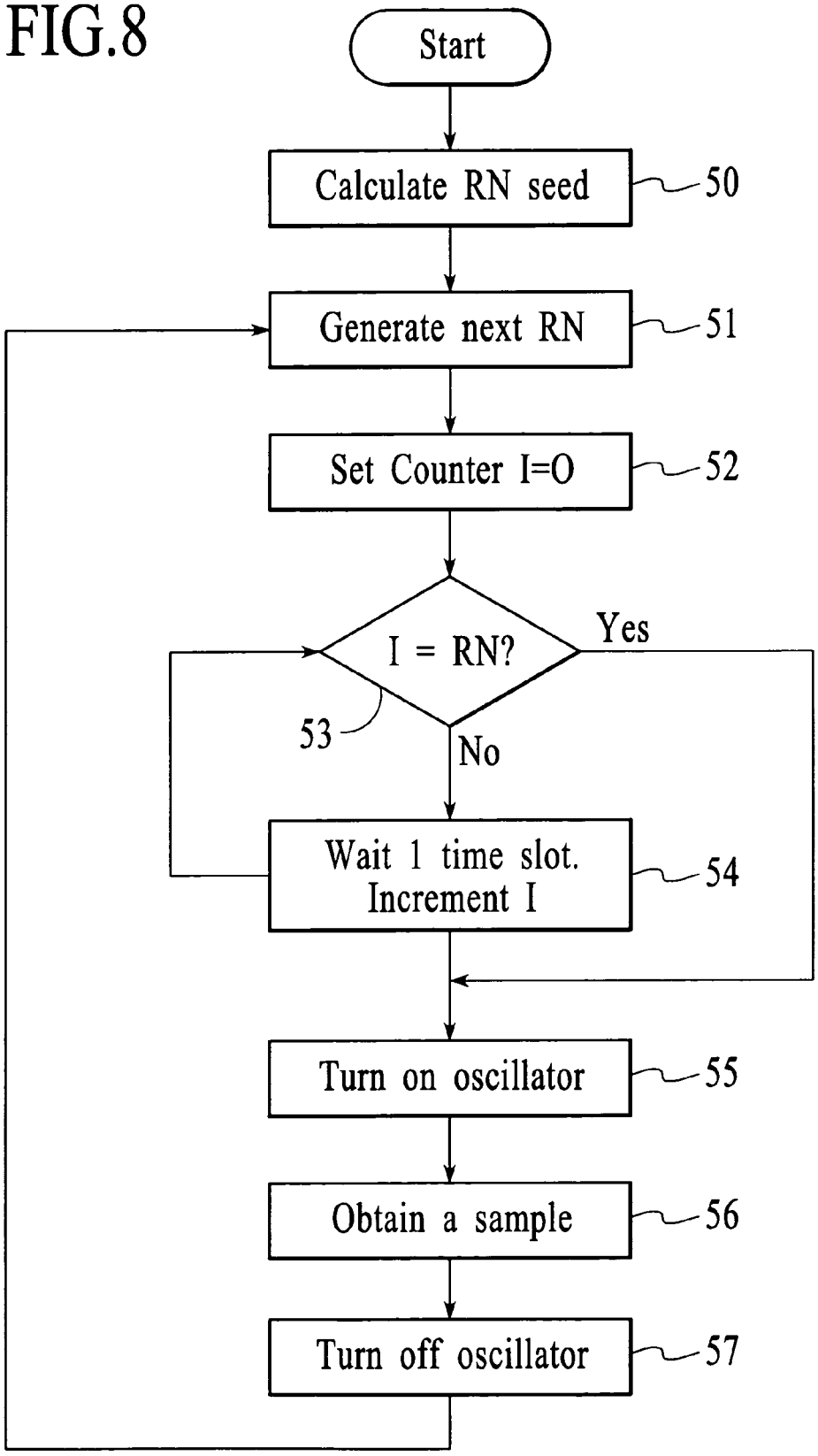
FIG. 8 depicts a flow diagram of a random sampling process.

In accordance with an embodiment of invention, a control signal is produced by the control system 14 to energize the loop 12 in order to obtain the random samples. FIG. 8 depicts a flow diagram of a random sampling process. Upon startup, at block 50, a random number (RN) seed is calculated. At block 51, a random number is generated from the seed. At block 52, a counter value, I, is set equal to zero. At decision point 53, it is determined if the counter value is equal to the random number (e.g., I=RN). If the counter value and the random number are not equal, then at block 54, the system waits one time slot and the counter is incremented by one after the time slot has passed. If the counter value and random number are equal, at block 55, the oscillator is turned on. Turning on the oscillator energizes the inductive loop and causes the loop to resonate at its resonant frequency. At block 56, a sample is obtained from the detector. In an embodiment, the sample is obtained using the period measurement technique, which allows an accurate measurement of the period of the oscillating signal (and therefore the inductance of the loop) in as little as one cycle. Once the sample is obtained, at block 57, the oscillator is turned off. The process then returns to block 51, where the next random number is generated.

In an embodiment, the duration of a sampling frame is selected to be the maximum interval that will ever occur between oscillator "on" times. This time constraint may be applied to insure the detector will be responsive to the vehicles in the field of detection in a timely manner.

Referring back to the sampling event time line of FIG. 2, the time slots 19 are only a few of many repetitious time slots that make up a complete sampling frame 18. The sampling frames are also repetitious and they occur, in time, at the frame rate. The various time slots within each sampling frame represent the time in which the subject oscillator is operating during a particular sampling event. The duration of on time to off time of the detector oscillator is a constant which is dependent upon the number of time slots allocated to the sampling frames. The duty cycle of the oscillator 34 can be expressed as one divided by the total number of time slots contained in the frame:

< or >

$$\text{Duty cycle } (\%) = \frac{1}{\text{Number of time slots in each Frame}}$$

The elapsed time to detect various vehicles varies widely depending upon the application. In highway traffic applications, the rate of detection, known as the "scanning rate" is usually very fast, as the detection devices may well be used to determine speed, time-over-loop, occupancy, or other mathematical values, important to the evaluation of roadway traffic conditions. A vehicle detector used in this application may, indeed, have an elapsed time to detect period as short as a few milliseconds. In other applications, such as access control and parking systems, the detection time may be as long as a few seconds. These variations in the detection time allow the numbers in the probability equations to be varied to create a balance of response time and create a very long time interval between the theoretical collision times between two vehicle detector oscillator occurrences.

Referring again to FIG. 2, each time slot 19 represents an interval of time where a random sampling event (e.g., $S_1$, $S_2$, $S_3$, $S_4$, and $S_5$) can occur. In an embodiment, a sampling event involves the determination of the inductive value of the loop system during a time slot. A single sampling event occurs once in each frame 18. If two vehicle detector loop systems using the principals described herein are in close enough proximity to each other, their associated sample periods would have to coincide for one or both inductive measurements to be invalid. If two vehicle detectors using random sampling as described herein both have a number, S, of time slots in each frame, the probability of concurrent sampling (also referred to as a "collision" can be expressed as:

$$\text{Probability of collision} = 1 - \left(\frac{S-1}{S}\right)$$

It should be noted that the number of time slots used can be any number restricted only by the practicality of the system parameters. For the purpose of illustration if 1,000 time slots per sampling frame are used, then the probably of a collision between two systems can be expressed as:

$$\text{Probability of collision} = 1 - \left(\frac{1000-1}{1000}\right) = 0.001$$

In this example the probability of collision would be 0.001, or, one collision for every 1,000 frames examined by the systems.

Figure 9:
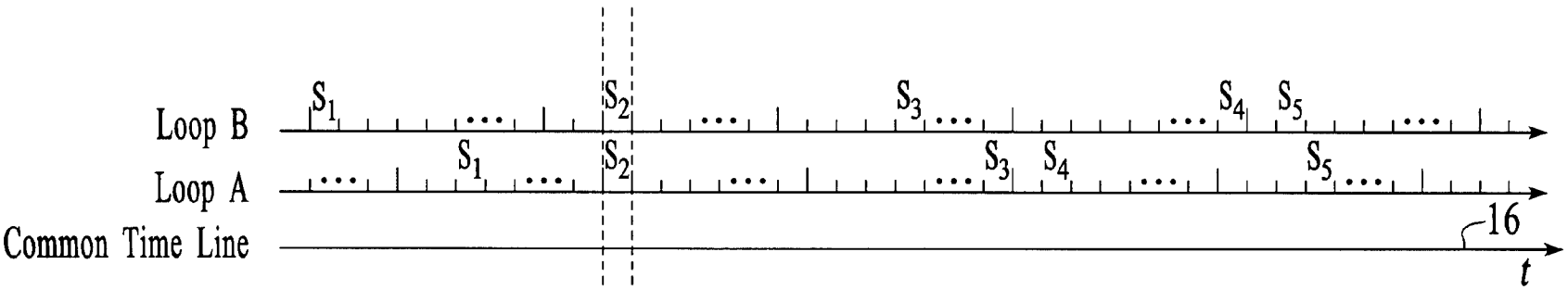
FIG. 9 depicts sampling event time lines for two inductive loop vehicle detection systems that utilize random sampling.
Figure 10A:
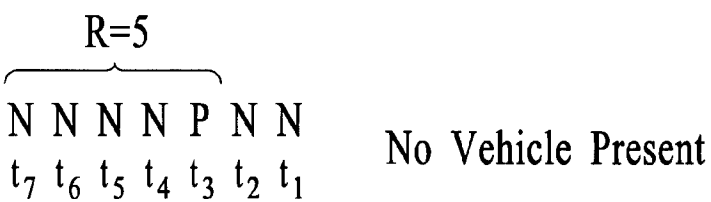
FIG. 10A depicts exemplary sample results from consecutive sampling frames in which only one positive (P) result is received.
Figure 10B:
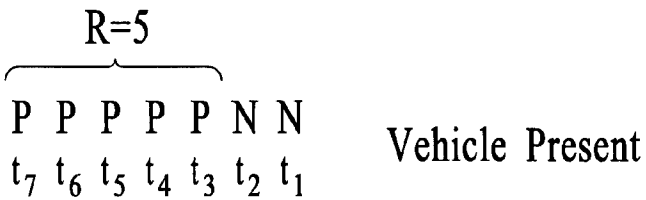
FIG. 10B depicts exemplary sample results from consecutive sampling frames in which five positive (P) results are returned in a row.

Validity checking involves putting some mechanism in place to weed out bad data to avoid determining the presence of a vehicle where none exists or determining the absence of a vehicle when a vehicle does exist. An example technique for validity checking involves requiring a certain number of consecutive frame detections before the presence of a vehicle is determined. This technique, when used in combination with random sampling can greatly reduce the probability of concurrent sampling events causing an incorrect vehicle determination. An example validity checking technique is described with reference to FIGS. 9 and 10. FIG. 9 depicts sampling event time lines for two inductive loop vehicle detection systems A and B that utilize random sampling as described herein. At some point during the random sampling, it is possible that sampling events occur concurrently (e.g., sampling events $S_2$). Interference from the concurrent sampling events may cause one or both of the systems to return incorrect results. For example, a positive result may be returned when a vehicle is not present. If taken alone, the incorrect positive result, referred to herein as a "false positive," would cause the system to incorrectly determine that a vehicle is present. However, if a certain number of consecutive positive results are required before a vehicle determination is made (e.g., five consecutive positive results, R=5), the probability of an incorrect vehicle determination can be greatly reduced. FIG. 10A depicts exemplary sample results from consecutive sampling frames (e.g., frames beginning at $t_1$, $t_2$, $t_3$, $t_4$, $t_5$, $t_6$, and $t_7$). As depicted, the first two samples return negative (N) results (e.g., no vehicle present). The next sample returns a positive (P) result while the last four samples return negative results. Because five positive results were not received consecutively, the presence of a vehicle is not determined. On the other hand, FIG. 10B depicts exemplary sample results from consecutive sampling frames in which five positive results are returned in a row. After the fifth positive result, it is determined that a vehicle is present. When the consecutive sampling requirement is applied to the random sampling technique, the probability of an incorrect vehicle determination can be expressed as:

$$\text{Probability of incorrect vehicle determination} = \left(1 - \left(\frac{S-1}{S}\right)\right)^R$$

Where R is the term added to the probability equation and is defined to be the number of consecutive false positives (or collisions) that must occur. Although one technique of validity checking is described for example purposes, other techniques of validity checking can be used in conjunction with random sampling to reduce the occurrence of incorrect vehicle determinations. For example, techniques involving value checking may be used (e.g., making sure all measurements are "reasonable" and within certain specified parameters. In addition, validity checking can be applied to both positive and negative results.

Validity checking may be, in its simplest form, the fact that the control system might ignore the existence of the number, R, of sequential time slots, S. That is, in its simplest form, R could be equal to 1 and therefore ignored in the above equation. If R=1, then no validation would be taking place and the occurrence of just one false positive would be enough to determine that a vehicle is present.

As an example, if the number of time slots, S, is set to 1,000 and the number of consecutive frames that would have to occur to produce false positives is set at 5 then the probability equation above becomes:

Probability of incorrect vehicle determination=

$$\left(1-\left(\frac{1000-1}{1000}\right)\right)^5=1\times10^{-15}$$

Or there will be an occurrence of 5 consecutive collisions every $10^{15}$ frames. That is, there will be one chance every $10^{15}$ samples that 5 samples in a row will indicate the presence of a vehicle when in fact no vehicle is present or visa versa.

Statistical probability can be applied to various situations and it will now yield the time that will exist before two vehicle detectors will experience a malfunction when both systems are using the principals defined herein.

The frame rate is another variable that is assigned to the algorithm and is dependent only on the rate the system is taking a measurement of the inductance of the loop to determine of the presence or absence of the motor vehicle. In the field of high speed freeway traffic conditions, if the sampling frame used is $1\times10^{-3}$ seconds in length, then the occurrence of a period of invalid data for the detectors would be:

Occurrence of bad detection=$1\times10^{15}$ frames$\times1\times10^{-3}$ seconds per frame=$10^{12}$ seconds or 31,709 years.

In the field of vehicular access control, the frame period can be a much slower rate, for example, a frame rate of $1\times10^{-1}$ seconds which would yield a time of 3,170,900 years.

Figure 11:
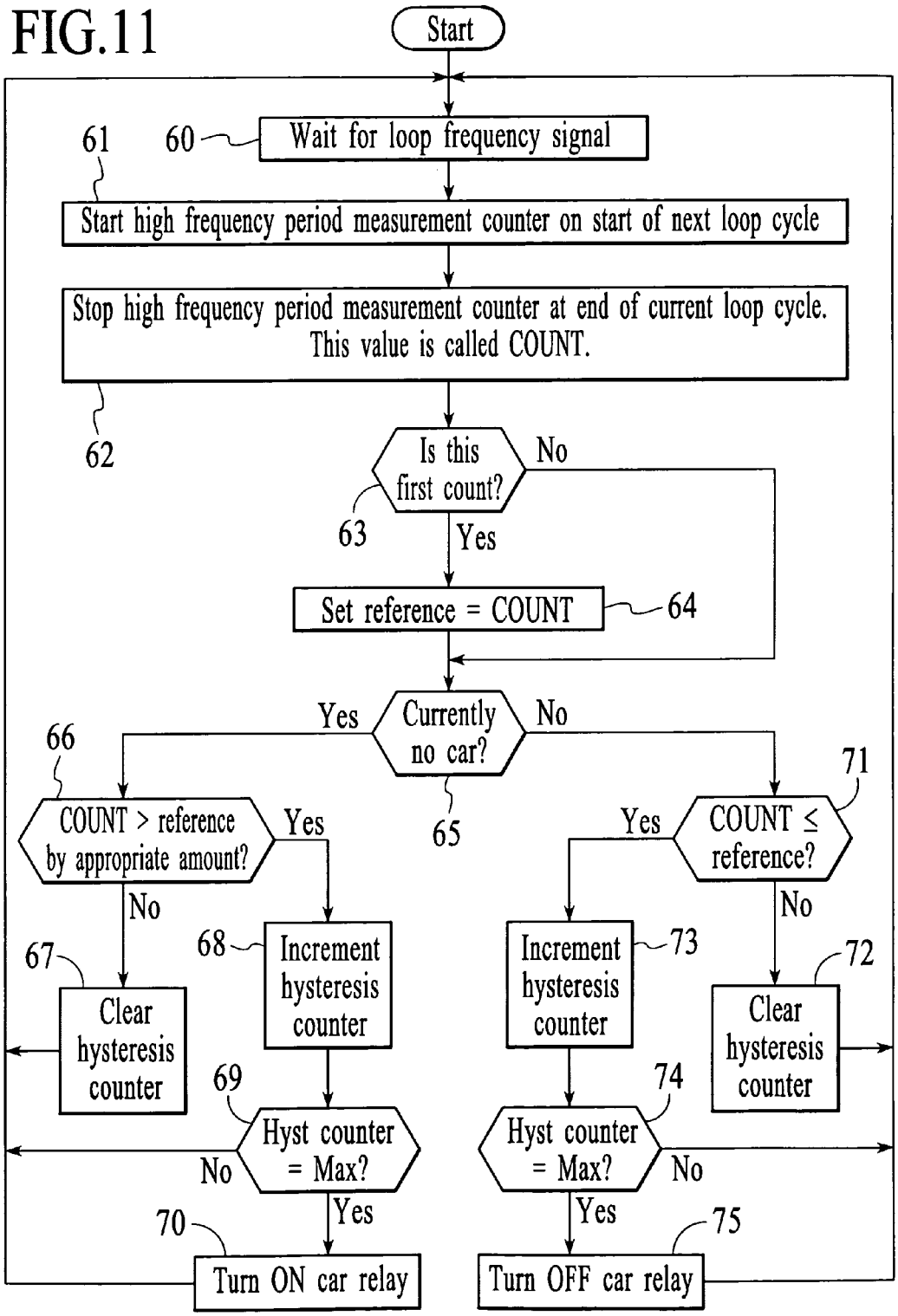
FIG. 11 depicts an exemplary results analysis process that includes validity checking.

FIG. 11 depicts an exemplary results analysis process that includes validity checking. The process starts at block 60 by waiting for a loop frequency signal. At block 61, at the start of the next loop cycle, a high frequency period measurement counter is started. At block 62, at the end of the current loop cycle, the high frequency period measurement counter is stopped. The value of the stopped counter is called "COUNT." At decision point 63, it is determined if this is the first count. If this is the first count, then a reference value (Reference) is set equal to COUNT (block 64) and if not then the process skips directly to decision point 65. At decision point 65 it is determined from the COUNT value whether a car is present. In an example, a car is determined to be present from the current random sample. If there is not a car present (Yes), then the process goes to decision point 66. At decision point 66, it is determined if COUNT exceeds Reference by an appropriate amount. In an embodiment, the appropriate amount is set to any predetermined value that signifies that a vehicle is present. If the COUNT does not exceed the Reference by the appropriate amount, then at block 67 a hysteresis counter is cleared. If the COUNT does exceed the Reference by an appropriate amount, then at block 68 the hysteresis counter is incremented. At decision point 69, it is determined if the hysteresis counter has reached its pre-established maximum value. In an embodiment, the maximum hysteresis value represents the number of consecutive positive results that must be achieved before a vehicle presence or absence is determined. If the hysteresis counter is not at its maximum, then the process returns to the beginning. If the hysteresis counter is at its maximum, then the presence of a car is determined and a car relay is turned on at block 70.

Referring to decision point 65, if there is a car present (No), then the process goes to decision point 71. At decision point 71, it is determined if COUNT is equal to or less than Reference. If the COUNT is not equal to Reference, then at block 72 a hysteresis counter is cleared. If the COUNT is equal to or less than Reference, then at block 73 the hysteresis counter is incremented. At decision point 74, it is determined if the hysteresis counter has reached its pre-established maximum value. If the hysteresis counter is not at its maximum, then the process returns to the beginning. If the hysteresis counter is at its maximum, then at block 75 the absence of a car is determined and a car relay is turned off.

Figure 12:
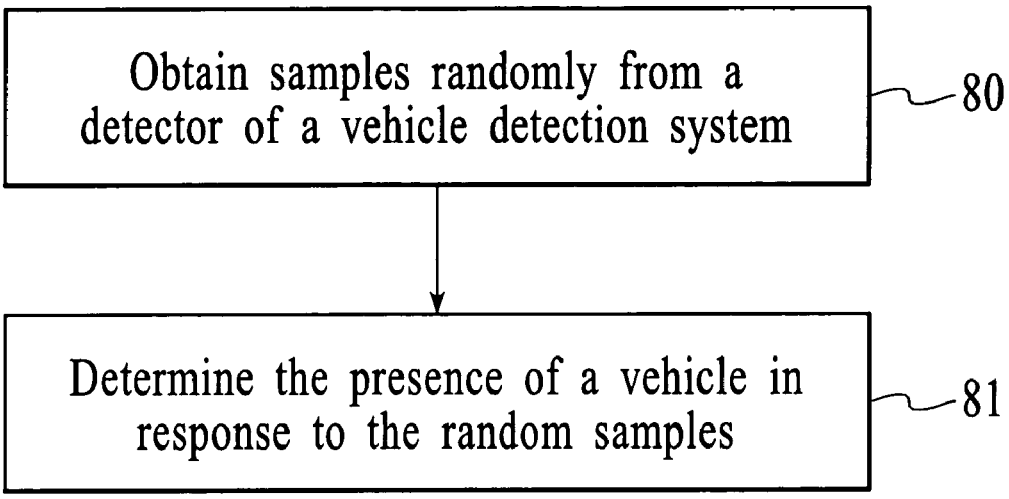
FIG. 12 depicts a process flow diagram of a method for operating a vehicle detection system.

FIG. 12 depicts a process flow diagram of a method for operating a vehicle detection system. At block 80, samples are obtained randomly from a detector of a vehicle detection system. At block 81, the presence of a vehicle is determined in response to the random samples.

Although a technique for obtaining samples randomly that involves repetitive sampling frames and time slots is described, other techniques for obtaining samples randomly are possible. The above-described random sampling techniques are applicable to other vehicle detection systems and other detection systems in general.

Also, the invention described above, uses a few specific examples for validity checking the results of the inductance values. Many more methods may exist and the above discussion should not be construed as limiting the possibilities.

Although specific embodiments of the invention have been described and illustrated, the invention is not to be limited to the specific forms or arrangements of parts as described and illustrated herein. The invention is limited only by the claims.

What is claimed is:

1. A method for operating a vehicle detection system comprising:

obtaining samples randomly from a detector of a vehicle detection system; and determining the presence of a vehicle in response to the random samples;

wherein obtaining samples randomly comprises:

establishing sampling frames;

dividing the sampling frames into time slots; and selecting one of the time slots from which to obtain a random sample.

2. The method of claim 1 wherein the selecting comprises randomly generating a value that corresponds to one of the time slots.

3. The method of claim 1 further including obtaining a sample related to the selected time slot.

4. The method of claim 3 further including repeating the selecting and the obtaining a sample related to the selected time slot for subsequent sampling frames.

5. The method of claim 1 wherein obtaining random samples comprises obtaining frequency or period samples at random time intervals.

6. The method of claim 1 wherein obtaining samples randomly comprises energizing the detector at random time intervals.

7. The method of claim 1 wherein the determining further comprises:

checking the validity of the random samples; and determining the presence of a vehicle in response to the validity check.

8. A method for operating multiple vehicle detection systems that are located in close proximity to each other comprising:

obtaining samples randomly from a first detector; and obtaining samples randomly from a second detector that is in close proximity to the first detector;

wherein the random samples from the first detector and the random samples from the second detector are obtained independent of each other.

9. The method of claim 8 further comprising:

determining the presence of a vehicle above the first detector in response to the random samples from the first detector; and determining the presence of a vehicle above the second detector in response to the random samples from the second detector.

10. The method of claim 8 wherein obtaining samples randomly comprises:

establishing sampling frames;

dividing the sampling frames into time slots;

selecting one of the time slots from which to obtain a random sample from the first detector; and selecting one of the time slots from which to obtain a random sample from the second detector.

11. The method of claim 10 wherein the time slots for die first and second detectors are selected by independently generating random values that correspond to time slots for the respective detectors.

12. The method of claim 8 wherein the random samples are obtained by energizing the corresponding detector at random intervals.

13. The method of claim 9 wherein:

determining the presence of a vehicle above the first detector in response to the random samples from the first detector involves checking the validity of the random samples; and determining the presence of a vehicle above the second detector in response to the random samples from the second detector involves checking the validity of the random samples.

14. A control system for a vehicle detection system comprising:

means for obtaining samples randomly from a detector of a vehicle detection system; and means for determining the presence of a vehicle in response to the random samples;

wherein the means for obtaining samples randomly comprises means for:

establishing sampling frames;

dividing the sampling frames into time slots; and selecting one of the time slots from which to obtain a random sample.

15. The control system of claim 14 wherein the means for selecting further comprises means for randomly generating a value that corresponds to one of the time slots.

16. The control system of claim 14 further comprising means for obtaining a random sample related to the selected time slot.

17. The control system of claim 16 further including means for repeating the selecting and obtaining a random sample related to the selected time slot for subsequent sampling frames.

18. The control system of claim 14 further comprising a random number generator in signal communication with the means for obtaining samples randomly.

19. The control system of claim 14 wherein the means for determining further comprises means for:

checking the validity of the random samples; and determining the presence of a vehicle in response to the validity check.

20. The control system of claim 14 wherein said means for obtaining samples randomly further comprises means for energizing the detector at random intervals.

21. A control system for multiple vehicle detection systems that are located in close proximity to each other comprising:

means for obtaining samples randomly from a first detector; and means for obtaining samples randomly from a second detector that is in close proximity to the first detector;

wherein the means for obtaining samples randomly from the first detector and the means for obtaining samples randomly from the second detector are independent of each other.

22. The control system of claim 21 further comprising:

means for determining the presence of a vehicle above the first detector in response to the random samples from the first detector; and means for determining the presence of a vehicle above the second detector in response to the random samples from the second detector.

23. The control system of claim 21 wherein:

the means for obtaining samples randomly from the first detector comprises means for establishing sampling frames of a known duration, dividing the sampling frames into time slots, and selecting one of the time slots from which to obtain a random sample from the first detector; and the means for obtaining samples randomly from the second detector comprises means for establishing sampling frames of a known duration, dividing the sampling frames into time slots, and selecting one of the time slots from which to obtain a random sample from the second detector.

24. The control system of claim 23 wherein the time slots for the first and second detectors are selected by independently generating random values that correspond to time slots for the respective detectors.

25. The control system of claim 21 further comprising at least one random number generator configured to generate random numbers for use in obtaining the random samples.

26. The control system of claim 22 wherein:

the means for determining the presence of a vehicle above the first detector in response to the random samples from the first detector includes means for checking the validity of the random samples; and the means for determining the presence of a vehicle above the second detector in response to the random samples from the second detector includes means for checking the validity of the random samples.

27. A control system for a vehicle detection system comprising:

a sample controller configured to obtain samples randomly from a detector of a vehicle detection system; and a processing unit, in signal communication with the sample controller, configured to determine the presence of a vehicle in response to the random samples;

wherein the sample controller is configured to:

establish sampling frames of a known duration;

divide the sampling frames into time slots; and select one of the time slots from which to obtain a random sample.

28. The control system of claim 27 further comprising a random number generator configured to generate a random value that corresponds to one of the time slots.

29. The control system of claim 27 wherein the sample controller is configured to obtain a random sample related to the selected time slot.

30. The control system of claim 28 wherein the sample controller is configured to repeat the selecting and obtaining the random samples for subsequent sampling frames.

31. The control system of claim 27 further comprising a random number generator configured to generate random numbers for use in obtaining the random samples.

32. The control system of claim 27 wherein the sample controller includes an oscillator controller configured to randomly energize the detector.

33. The control system of claim 27 wherein the processing unit is further configured to:

checking the validity of the random samples; and determine the presence of a vehicle in response to the validity checking.

34. A control system for multiple vehicle detection systems that are located in close proximity to each other comprising:

a sample controller configured to obtain samples randomly from a first detector; and a sample controller configured to obtain samples randomly from a second detector that is in close proximity to the first detector;

wherein the sample controller for the first detector and the sample controller for the second detector are independent of each other.

35. The control system of claim 34 further comprising:

a first processing unit configured to determine the presence of a vehicle above the first detector in response to the random samples from the first detector; and a second processing unit configured to determine the presence of a vehicle above the second detector in response to the random samples from the second detector.

36. The control system of claim 34 wherein:

the first sample controller is configured to establish sampling frames of a known duration, divide the sampling frames into time slots, and select one of the time slots from which to obtain a random sample from the first detector; and the second sample controller is configured to establish sampling frames of a known duration, divide the sampling frames into time slots, and select one of the time slots from which to obtain a random sample from the second detector.

37. The control system of claim 36 wherein the time slots for the first and second detectors are selected by independently generating random values that correspond to time slots for the respective detectors.

38. The control system of claim 34 wherein:

the first processing unit is configured to check the validity of the random samples from the first detector; and the second processing unit is configured to check the validity of the random samples from the second detector.

39. A method for operating an inductive loop vehicle detection system comprising:

randomly energizing a loop detector of an inductive loop vehicle detection system; and determining the presence of a vehicle in response to the random energizing.

40. The method of claim 39 wherein randomly energizing the loop detector comprises:

establishing sampling frames of a known duration;

dividing the sampling frames into time slots; and selecting one of the time slots from which to obtain a random sample.

41. The method of claim 40 wherein the selecting comprises randomly generating a value that corresponds to one of the time slots.

42. The method of claim 39 further including obtaining sample measurements of frequency or period in response to the random energizing.

43. The method of claim 39 wherein randomly energizing the loop detector includes generating random numbers that are used to determine when the loop detector is energized.

44. The method of claim 39 wherein the determining further comprises:

checking the validity of the random samples; and determining the presence of a vehicle in response to the validity check.

45. A method for operating a vehicle detection system comprising:

obtaining samples randomly from a detector of a vehicle detection system; and determining the presence of a vehicle in response to the random samples;

wherein obtaining samples randomly comprises energizing the detector at random time intervals.

46. A method for operating a vehicle detection system comprising:

obtaining samples randomly from a detector of a vehicle detection system; and determining the presence of a vehicle in response to the random samples;

wherein the determining further comprises:

checking the validity of the random samples; and determining the presence of a vehicle in response to the validity check.

47. A control system for a vehicle detection system comprising:

means for obtaining samples randomly from a detector of a vehicle detection system; and means for determining the presence of a vehicle in response to the random samples;

wherein the means for determining further comprises means for:

checking the validity of the random samples; and determining the presence of a vehicle in response to the validity check.

48. A control system for a vehicle detection system comprising:

means for obtaining samples randomly from a detector of a vehicle detection system; and means for determining the presence of a vehicle in response to the random samples;

wherein said means for obtaining samples randomly further comprises means for energizing the detector at random intervals.

49. A control system for a vehicle detection system comprising:

a sample controller configured to obtain samples randomly from a detector of a vehicle detection system; and a processing unit, in signal communication with the sample controller, configured to determine the presence of a vehicle in response to the random samples;

wherein the sample controller includes an oscillator controller configured to randomly energize the detector.

50. A control system for a vehicle detection system comprising:

a sample controller configured to obtain samples randomly from a detector of a vehicle detection system; and a processing unit, in signal communication with the sample controller, configured to determine the presence of a vehicle in response to the random samples;

wherein the processing unit is further configured to:

checking the validity of the random samples; and determine the presence of a vehicle in response to the validity checking.

* * * * *